US008376498B1

(12) United States Patent
Mandel et al.

(10) Patent No.: US 8,376,498 B1
(45) Date of Patent: Feb. 19, 2013

(54) HIGH PRODUCTIVITY SPREADER/TRANSFIX SYSTEM FOR DUPLEX MEDIA SHEETS IN AN INKJET PRINTER

(75) Inventors: Barry P. Mandel, Fairport, NY (US); Paul J. McConville, Webster, NY (US); Injae Choi, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/251,533

(22) Filed: Oct. 3, 2011

(51) Int. Cl.
*B41J 29/38* (2006.01)
*B41J 2/01* (2006.01)

(52) U.S. Cl. ..... 347/16; 347/103; 399/308; 399/309

(58) Field of Classification Search ..... 347/16, 347/103
See application file for complete search history.

(56) References Cited

U.S. PATENT DOCUMENTS

| | | | | |
|---|---|---|---|---|
| 5,799,236 | A | 8/1998 | Paczkowski | |
| 5,835,831 | A | 11/1998 | Staudenmayer et al. | |
| 2009/0027436 | A1 | 1/2009 | McConville et al. | |
| 2009/0297234 | A1 | 12/2009 | Cahill | |
| 2011/0149001 | A1 | 6/2011 | Chappell et al. | |
| 2011/0221812 | A1 | 9/2011 | Ryan et al. | |
| 2012/0256993 | A1 * | 10/2012 | Park et al. | 347/103 |

* cited by examiner

*Primary Examiner* — Julian Huffman
(74) *Attorney, Agent, or Firm* — Maginot, Moore & Beck, LLP

(57) ABSTRACT

A method of operating a printer produces duplex images with improved throughput. The method monitors the position of an area of pressure roller that carries release agent and synchronizes a media transport to insert a media sheet into a nip formed with the pressure roller so the release agent on the pressure roller exits the nip as the leading edge of the media sheet enters the nip. The circumference of the pressure roller is an integral number times the length of the media sheet plus inter-document gap.

25 Claims, 7 Drawing Sheets

HIGH PRODUCTIVITY SPREADER/TRANSFIX SYSTEM FOR DUPLEX MEDIA SHEETS IN AN INKJET PRINTER

TECHNICAL FIELD

This disclosure relates to inkjet printers and, more particularly, to transferring ink images to media in these printers.

BACKGROUND

Drop on demand inkjet printing systems eject ink drops from printhead nozzles in response to pressure pulses generated within the printhead by either piezoelectric devices or thermal transducers, such as resistors. The ink drops are ejected toward a media sheet where each ink drop forms a spot on the media sheet. The printheads have a plurality of inkjet ejectors that are fluidly connected at one end to an ink supplying manifold through an ink channel and at another end to a nozzle, sometimes called an aperture, in a nozzle or aperture plate.

In some phase change or solid ink printers, known as direct printers, the printer ejects ink drops directly onto a print medium such as a paper sheet. After ink drops are printed on the print medium, the printer moves the print medium through a nip formed between two rollers that apply pressure and optionally heat to the ink drops and print medium. One roller, referred to as the "spreader roller" contacts the printed side of the print medium. The spreader roller is heated and coated with a release agent that prevents ink drops on the print medium from transferring onto the spreader roller. The second roller is referred to as a "pressure roller." This roller presses the media against the spreader roller. The pressure roller may be optionally heated to facilitate the fixing of the ink to the sheet of print medium. The heat and pressure applied through the nip flattens the ink drops and secures the printed ink image to the print medium in a process known as "fixing."

In an indirect printing embodiment, the printer ejects ink drops onto an intermediate member such as a rotating drum or endless belt. A pressure roller referred to as a "transfix" roller is positioned against the intermediate member to form a transfix nip. A media sheet passes through the transfix nip, and the ink image on the intermediate member transfers and fixes to the media sheet under pressure and heat in the transfix nip. The transfer and fixation of the ink image is referred to as a transfix process that is well known to the art.

Both direct and indirect inkjet printers are capable of producing either simplex or duplex prints. Simplex printing refers to production of an image on only one side of a print medium. Duplex printing produces an image on each side of a media sheet. In duplex direct printing, an ink image is formed on a first side of the media sheet and then the sheet passes through the spreader nip to fix the ink image onto the first side of the media sheet. The medium is then inverted and sent along a path that passes the second side of the media sheet by the printheads for the formation of a second ink image on the second side. The sheet then returns to the spreader nip where the second ink image is fixed to the second side of the media sheet. A similar process is used with indirect printing, except the image is initially formed on an intermediate drum and then transferred to the media and in an indirect system the image is fixed at the same time as the ink is transferred.

In both direct and indirect printing systems having significant levels of oil on the media before imaging is undesirable since the release agent can prevent ink from properly adhering or transferring to the media. Therefore, preventing the release agent from transferring to the back side of a sheet during printing of the first side image is desirable. Current printing systems must slow down and use special sequencing in duplex mode to prevent release from being transferred to the back of a sheet during front side printing. If the spreader roller and the pressure roller in the direct printer contact one another before a media sheet reaches the nip or between sheets as they pass through the nip, then release agent transfers from the spreader roller to the pressure roller. In an indirect printer, the transfix roller and intermediate member also contact one another before a media sheet reaches the transfix nip or between sheets as they pass through the nip and release agent transfers to the transfix roller from the intermediate member.

The amount of release agent on the pressure roller may reach a level that causes release agent to be transferred above the allowable limit from the pressure roller to the second side of a media sheet while an image is being fixed to the first side of the media sheet. For duplex prints, the excessive release agent transferred to the second side of the media sheet may interfere with the printing of ink images on the second side of the media sheet. In a direct printing system the presence of release agent between the ejected ink and the sheet may result in the transfer of some ink from the media sheet to the spreader roller during the fixing of the second image on the media sheet. In an indirect printing system, the presence of release agent on the media may result in some ink remaining on the intermediate member instead of transferring to the media. In both cases, the loss of ink produces an image having partial or missing pixels. When the partial or missing pixels are detectable by the human eye the phenomenon is known as image dropout.

One way of addressing the buildup of release agent on the pressure roller is to keep the two rollers separate from each other until a media sheet is presented for the fixing operation. That is, the one roller can be selectively positioned with respect to the other roller. Thus, if the movable roller comes into contact with the other roller as the media sheet approaches the rollers, then little or no release agent is transferred from the spreader roller to the pressure roller. This synchronization, however, requires sophisticated control techniques and, during high speed duplex printing, the movement of the one roller can become unwieldy or a limit to the throughput of the printer. Consequently, improved operation of direct and indirect printers that addresses this limitation would be beneficial to higher throughput.

SUMMARY

In one embodiment, a method of operating a printer has been developed. The method includes ejecting ink drops into an area having a predetermined size on a moving surface to form a first ink image, identifying a first portion of a surface of a first roller having release agent, the first portion of the surface of the first roller having release agent being less than a circumference of the first roller and the circumference of the first roller being greater than a length of the area having the predetermined size in which the first ink image was formed, identifying a rotational position of the first portion of the surface of the first roller having release agent, and operating a media transport to insert a leading edge of a media sheet into a nip formed with the first roller as the identified rotational position of the first portion of the surface of first roller having release agent exits the nip.

In another embodiment, an inkjet printer has been developed. The printer includes a printhead configured to eject ink drops into an area having a predetermined size on a moving surface to form a first ink image, a sensor configured to generate a signal that identifies a rotational position of a portion of a surface of a first roller having release agent; and a controller. The controller is configured to operate a media transport to insert a leading edge of a media sheet into a nip formed with the first roller as the identified rotational position of the portion of the surface of first roller having release agent exits the nip. A circumference of the first roller is greater than a length of the area having the predetermined size.

BRIEF DESCRIPTION OF THE DRAWINGS

The foregoing aspects and other features of a media path in a printer that controls the distribution of release agent between rollers that engage media sheets is explained in the following description taken in connection with the accompanying drawings.

DETAILED DESCRIPTION

Figure 1:
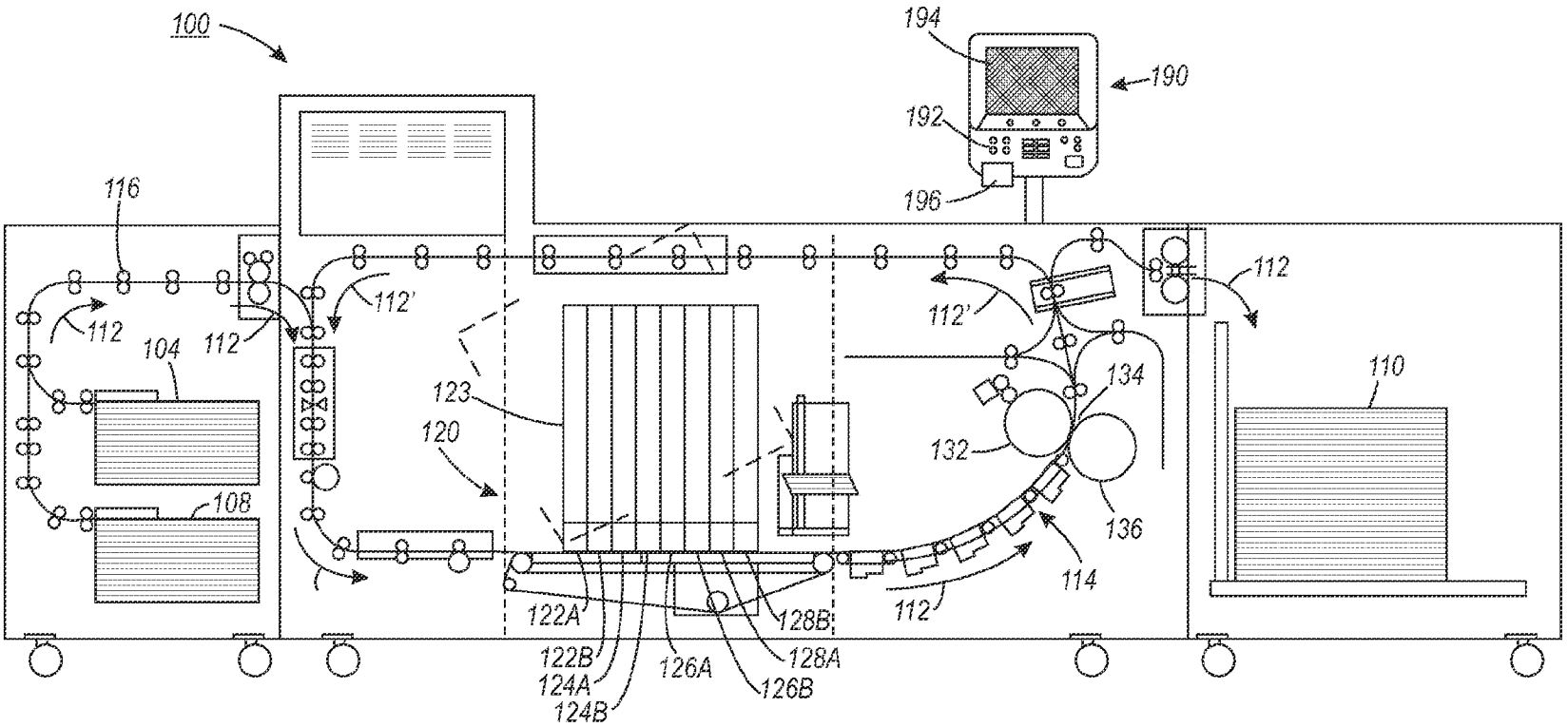
FIG. 1 is a schematic view of an inkjet printer that is configured to print images directly onto media sheets.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images on media for any purpose, such as a digital copier, bookmaking machine, facsimile machine, a multi-function machine, or the like. The systems and methods described below may be used with various printer embodiments. A direct printer ejects ink drops directly onto print media to form ink images on the media and subsequently fixes the ink image to the media sheet. An indirect printer forms an ink image on an intermediate image receiving member, such as a drum or endless belt, and transfers the ink image to a media sheet in a "transfix" operation that is well-known in the art. A "media sheet" or "print medium" as used in this description may refer to any type and size of medium on which printers in the art produce images, including printer paper of various sizes. Each media sheet includes two sides, and each side may receive an ink image corresponding to one printed page.

As used herein, the term "image receiving member" refers to any member having a surface that is configured to receive an ink image. In a direct printer, the image receiving member is typically print media, such as a paper sheet or continuous media web. In an indirect printer, the image receiving member is typically a rotating drum or endless belt that receives ink ejected by one or more printheads to form ink images. In a direct printer, a media transport carries print media along a media path past printheads in a print zone, while in an indirect printer the image receiving member rotates or moves past the printheads in a repeating manner.

Phase change ink printers use phase change ink, also referred to as a solid ink, which has a solid state at room temperature but melts into a liquid at a higher operating temperature. The liquid ink drops are printed onto an image receiving member in either a direct or indirect printer. As described in more detail below, both direct and indirect printers apply a coating of release agent to selected components in the printer to prevent phase change ink from adhering to the printer components instead of the print medium. In one embodiment, the release agent is an oil such as silicone oil.

FIG. 1 depicts a direct inkjet printer 100 that controls a transfer of release agent between two rollers 132 and 136 while printing in a duplex mode. Printer 100 includes media supplies 104 and 108, a media path 112, print zone 120, a media sheet conveyor 114, spreader roller 132, pressure roller 136, media output tray 110, and a controller 190.

The media supplies 104 and 108 are each configured to hold a plurality of media sheets and supply the media sheets to the printer via the media path 112 for printing. In the embodiment of printer 100, the media supplies 104 and 108 can hold media sheets of different sizes. For example, the media supply 104 holds size A4 (210 mm×297 mm) media sheets, while the media supply 108 holds tabloid size media sheets (279 mm×432 mm). In alternative configurations, either or both media supplies 104 and 108 hold media sheets having letter size (215.9 mm×279.4 mm), legal size (216 mm×356 mm), or various other sheet sizes. Various printer embodiments move the media sheets in either a length or width orientation during printing. Thus, the "length" of a media sheet in the process direction can be either of the length or width dimensions commonly used to describe a media sheet size. For example, the length of a letter size media sheet in the process direction can be either 215.9 mm or 279.4 mm depending on the orientation of the media sheet as a media transport moves the media sheet in a process direction through the printer.

During a print job, media sheets from one or both of the media supplies 104 and 108 move along the media path 112. The media path 112 is a media transport that includes a plurality of guide rollers, such as guide rollers 116, which engage each media sheet and move the media sheets through the printer 100. In FIG. 1, the media path 112 guides each media sheet past a print zone 120 in a process direction for imaging operations on a first side of each media sheet. A portion of the media path 112' reverses an orientation of the media sheets and directs the media sheets through the print zone 120 a second time in the process direction to enable the print zone 120 to print ink images during imaging operations on the second side of each media sheet. As described in more detail below, a portion of the media path 112 between the print zone 120 and the rollers 132 and 136 includes a series of variable speed conveyors 114.

The print zone 120 includes a plurality of printheads arranged in a cross-process direction across a width of each media sheet. In FIG. 1, the print zone 120 includes a total of eight marking stations configured to print color images using a combination of cyan, magenta, yellow, and black (CMYK) inks. In the print zone 120, marking stations 122A and 122B print magenta ink, marking stations 124A and 124B print cyan ink, marking stations 126A and 126B print yellow ink, and marking stations 128A and 128B print black ink. Various alternative configurations print with a single color of ink, or include different ink colors including spot colors. Each of the marking stations 122A-128B includes a plurality of printheads that each includes a plurality of inkjets.

The printheads in each set of marking stations 122A-122B, 124A-124B, 126A-126B and 128A-128B are arranged in interleaved and staggered arrays to enable printing over the entire cross-process width of a media sheet. For example, marking station 122A includes one array of staggered printheads that print images at a resolution of 300 drops per inch (DPI) in the cross-process direction over a media sheet. Each printhead in the staggered array covers a portion of the width of the media sheet, and the printheads are aligned end-to-end in the cross-process direction to print a continuous line of ink drops across the media sheet. Marking station 122B includes a second staggered array of printheads that are interleaved with the printheads in the marking station 122A to enable both of the marking stations to print magenta ink with a combined resolution of 600 DPI in the cross-process direction.

In the print zone 120, the printheads in each marking station print liquid drops of a phase change ink. In one embodiment, the ink is supplied as a series of solid ink sticks to each of the marking stations 122A-128B. A heater positioned in each marking station gradually melts the ink to supply liquefied ink to the corresponding printhead array. As depicted in FIG. 1, each marking station includes a set of supporting electronics 123. The electronics 123 include driver electronics, which generate the signals that operate the printheads in the marking station 122A. The printheads are also supplied with ink from a supply. In one alternative configuration, two marking stations that print a single color of ink receive melted solid ink from a single supply. In another alternative configuration, the phase change ink is supplied in a plurality of granular pastilles instead of in the form of ink sticks. While printer 100 is depicted as using a phase-change ink, the methods described herein can also be used in xerographic printers and inkjet printers using alternative forms of ink including aqueous, gel, solvent based, and UV curable inks.

A media sheet moves through the print zone 120 to receive an ink image and the media path 112 moves the media sheet out of the print zone 120 in the process direction. The printheads in marking stations 122A-128B print ink drops onto a predetermined area of the surface of the media sheet as the media sheet moves through the print zone to form an ink image on the media sheet. A section of the media path 112 located after the print zone 120 includes one or more conveyors 114. The conveyors 114 are configured to control the velocity of the media sheet in the process direction as the media sheet approaches a nip 134 formed between spreader roller 132 and pressure roller 136. As described in more detail below, the printer 100 controls the rotation of the rollers 132 and 136 and the movement of media sheets on the conveyors 114 to enable each media sheet to pass through the nip 134 without a transfer of release agent to a non-imaged side of the media sheet during duplex print operations.

Figure 2A:
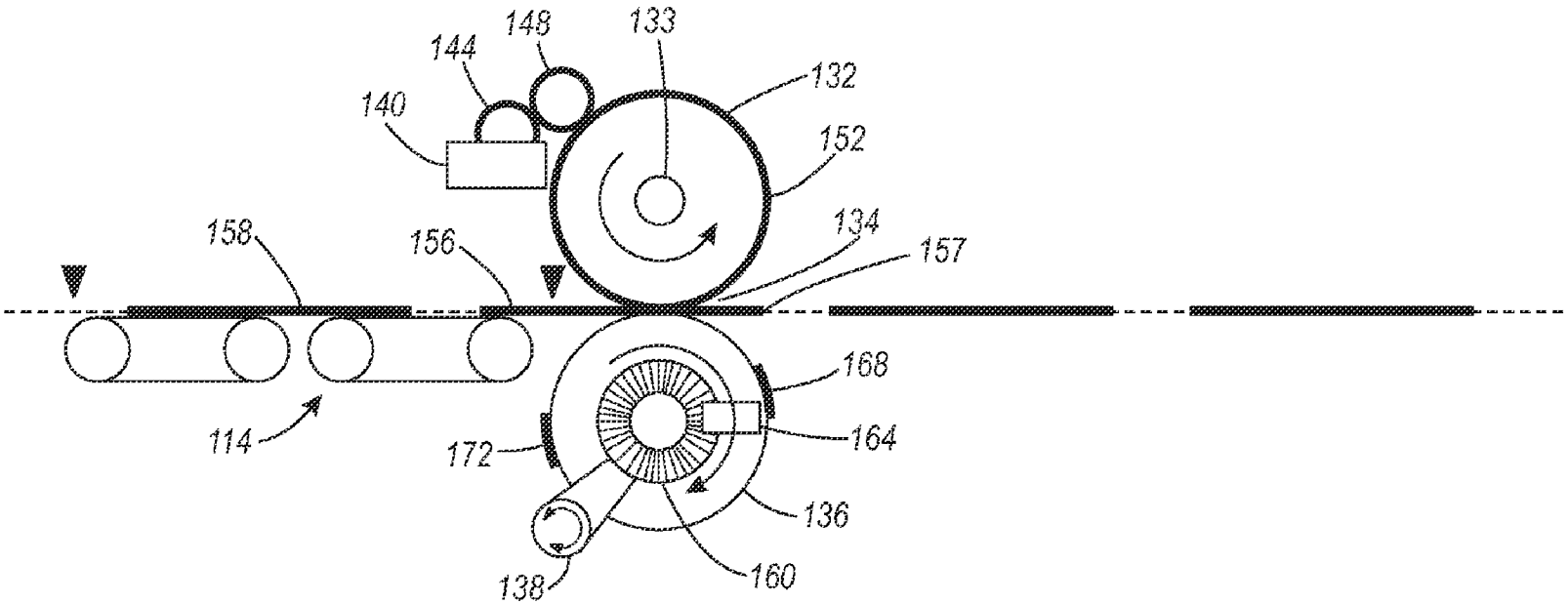
FIG. 2A is a schematic view of a spreader roller and a pressure roller that are used to fix printed ink images onto media sheets having a first size in the inkjet printer depicted in FIG. 1.
Figure 2B:
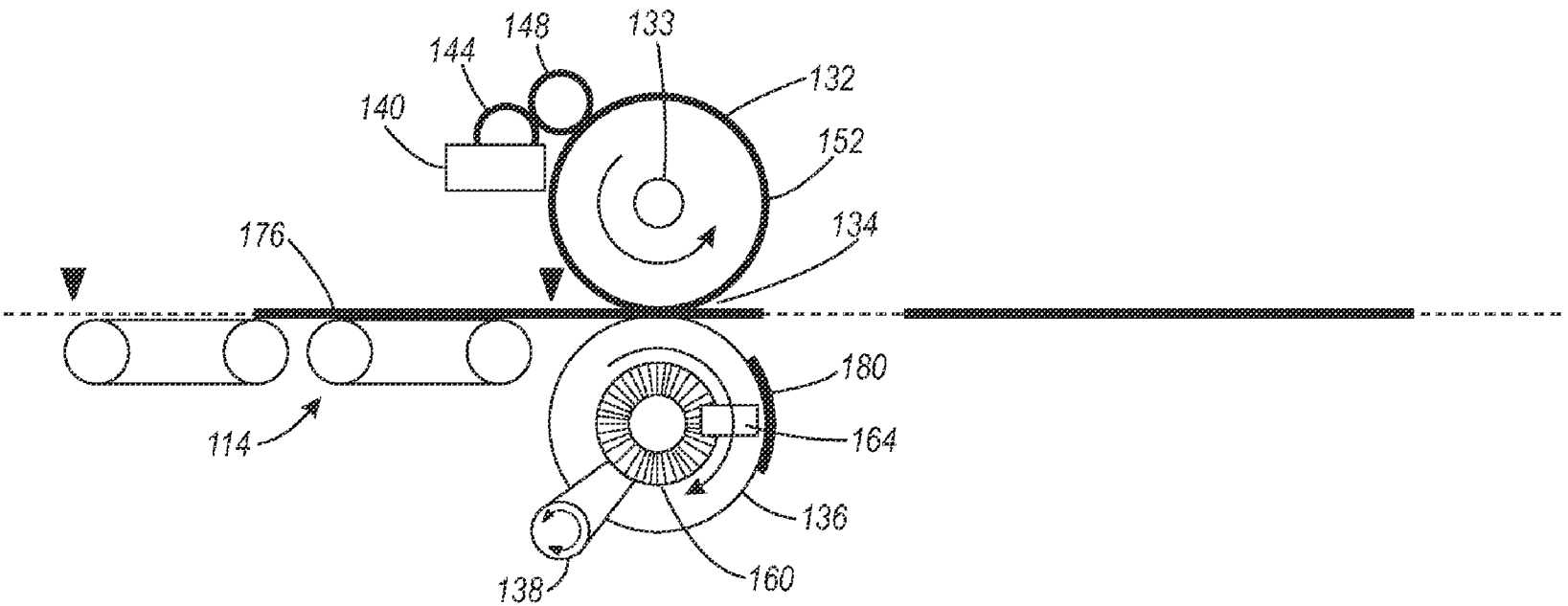
FIG. 2B is a schematic view of the two rollers of FIG. 2A operating in a mode to fix ink images onto media sheets having a second size.

FIG. 2A and FIG. 2B depict the rollers 132 and 136 in the printer 100. Media sheets pass through the nip 134 formed between the rollers 132 and 136. In the embodiment of printer 100, both the spreader roller 132 and pressure roller 136 apply pressure to media sheets as the media sheets pass through the nip 134. The spreader roller 132 engages the side of the media sheet that carries the ink drops formed on the sheet in the print zone, and the pressure applied to the media sheet spreads and fixes the ink to the media sheet. An actuator 133 rotates the spreader roller 132 to move media sheets in the process direction, and the friction between the rollers generates a counter-rotation in the pressure roller 136. In other embodiments, a separate drive motor rotates the pressure roller 136 to position the pressure roller 136 accurately during periods when the nip is split or opened. The side of each media sheet holding an ink image printed in the print zone 120 contacts the spreader roller 132, while pressure roller 136 contacts the opposite side of the media sheet. The rollers 132 and 136 apply pressure, and optionally heat, to the media sheet as the media sheet moves through the nip 134. The pressure and heat flatten individual ink drops formed on the media sheet so that the ink image formed on the media sheet is "fixed" to the sheet in a durable manner. A release agent 152 coats the surface of the spreader roller 132 that contacts the ink image on each media sheet. The release agent 152 is typically an oil, such as silicone oil, which prevents ink from adhering to the surface of the spreader roller 132. A drum maintenance unit 140 includes a reservoir holding the release agent. In the configuration of FIG. 2A, two applicator rollers 144 and 148 apply the release agent in a coating 152 formed around the spreader roller 132, although alternative embodiments use different mechanisms to apply the release agent coating 152.

During operation, the rotational position of the pressure roller 136 is monitored by a rotational sensor including an optical encoder disk 160 and a sensor 164. The optical encoder disk is axially mounted to the pressure roller 136 and rotates with the pressure roller 136. As the optical encoder 160 rotates, the encoder interrupts a light beam generated in the sensor 164. The sensor 164 generates signals corresponding to the interruptions in the light beam. The signals generated in the sensor 164 can identify both the rotational velocity of the pressure roller 136 and the rotational position of the pressure roller 136. In an alternative embodiment, the optical encoder disk includes a predetermined pattern of light and dark segments that alter the reflection of light from the surface of the optical disk to the sensor 164 as the optical encoder rotates. In still another embodiment, the pressure roller 136 is configured with a Hall Effect sensor.

During a print job where a series of media sheets pass through the nip 134, a portion of the release agent 152 formed on the roller 132 transfers to the roller 136. The release agent transfers from the spreader roller 132 to the roller 136 when the rollers rotate in contact with each other in gaps that separate consecutive media sheets. In FIG. 2A, release agent forms two patches 168 and 172 on two portions of the surface of the pressure roller 136 as the pressure roller 136 contacts the spreader roller 132 between media sheets 156. As used herein, both of the terms "patch of release agent" and "portion of a surface roller having release agent" refer to an area on a roller that has a significantly greater amount of release agent than the other portions of the roller. Some smaller amount of release agent may be present around the entire circumference of the roller.

In the configuration of FIG. 2A, the pressure roller 136 has an outer circumference that is greater than twice the length of each media sheet 156 in the process direction, and the pressure roller 136 engages two different media sheets during each rotation in a "two-pitch" configuration. As used herein, the term "pitch" refers to a portion of a surface of a roller that engages a media sheet and a gap between one media sheet and a subsequent media sheet during a single rotation of the roller. The term pitch is often referenced in conjunction with a numerical designation. For example, in a single-pitch configuration, a roller engages one media sheet during a single rotation. The roller has a circumference that is longer than a length of the sheet in the process direction, so a section of the single-pitch does not engage the media sheet. As described below, the section of the pitch that does not engage the media sheet can contact another roller and accumulate a patch of release agent.

A roller with an integer, non-fractional, number of pitches engages the entire length of an integer number of media sheets during a single rotation. In a two-pitch embodiment, the pressure roller has a circumference that is larger than two times a length of a letter size media sheet in the direction of roller rotation. The two-pitch roller engages two media sheets during a single rotation with gaps on the roller separating the two media sheets. Rollers having different circumferences and media sheet sizes can accommodate three or more pitches as well. A single roller can operate as a single-pitch or multi-pitch roller for different sizes of media sheets and gaps between the media sheets in various print modes. In one print mode in the printer 100, the media transport is operated in a two-pitch configuration to insert a leading edge of a next letter size media sheet into the nip as the identified portion of the surface of the pressure roller bearing the patch of release agent exits the nip.

The printer 100 controls the rotation of the rollers 132 and 136 and the speed of the media sheets 156 in the media path 112 to position a leading edge of each media sheet in the nip as one portion of the pressure roller 136 carrying the release agent exits the nip 134. For example, in FIG. 2A, a leading edge 157 entered the nip 134 as the release agent patch 168 exited the nip. The media sheet 156 contacts only one portion of the pressure roller 136 that is between the release agent patches 168 and 172. In a duplex print mode, the spreader roller 132 fixes the first printed side of the media sheet 156, and the second side of the media sheet 156 exits the nip 134 without receiving release agent from the pressure roller 136. A subsequent media sheet 158 enters the nip 134 as the release agent patch 172 exits the nip 134. Consequently, the print zone 120 prints an ink image on the second side of the media sheets in a duplex mode without dropout or other reductions in image quality due to release agent contamination on the second side of each media sheet.

Figure 4A:
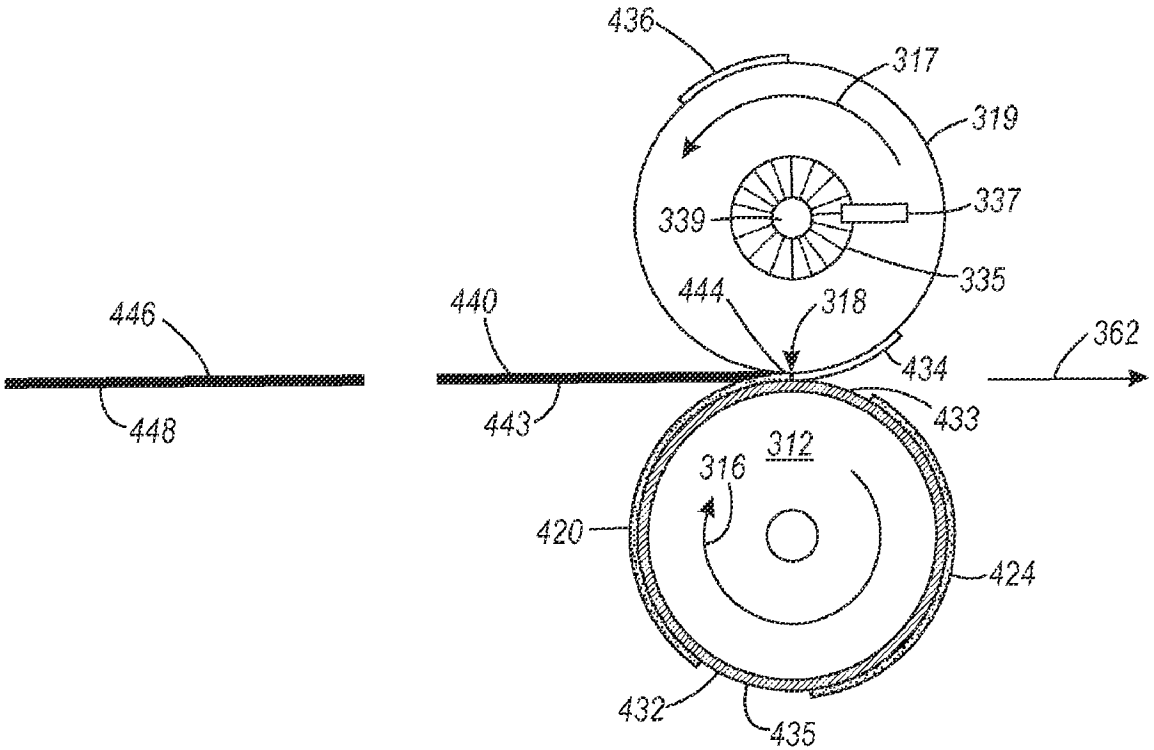
FIG. 4A is a schematic view of an imaging drum and a transfix roller that transfix latent ink images onto media sheets having a first size in the printer depicted in FIG. 3.

In some multi-pitch configurations, the printer provides an alternating sequence of media sheets to the nip to further control the transfer of release agent to a roller, such as pressure roller 136 or transfix roller 319, in a duplex print mode. Referring to FIG. 2A and FIG. 4A, the media sheets pass through the nip in an interleaved order where one sheet passes through the nip during a first side imaging operation and the following media sheet passes through the nip during a second side imaging operation. The alternating sequence of first and second side media sheets continues during the print job. For example, in FIG. 2A, a first side image formed on the media sheet 156 is fixed to the sheet as the sheet passes through the nip 134. The next media sheet 158 has previously undergone first side imaging, and a second side image is fixed to the second sheet 158 as the second media sheet 158 passes through the nip 134. In FIG. 4A, the ink image 420 transfixes to the first side 443 of media sheet 440 as the media sheet 440 passes through the transfix nip 318, and the ink image 424 transfixes to a second side 448 of the next media sheet 446. Various configurations of the direct printer 100 and the indirect printer 300 operating in a single-pass configuration sequence media sheets in an alternating first side and second side order. During the beginning of a print job, the printer operates in a reduced throughput print mode for a first number of media sheets until a sufficient number of media sheets with a first side image have been printed to enable the printer to provide the alternating sequence of first and second side media sheets to the nip.

The alternating media sheet sequence prevents a transfer of accumulated release agent from the pressure roller to an unprinted side of a media sheet during a duplex printing operation. During the second side printing, the previously printed first side of a media sheet contacts a pressure roller such as roller 136 or the transfix roller 319. Release agent that transferred to the media sheet during the imaging of the first side transfers to the roller as the media sheet passes through the nip a second time. While the amount of the release agent transferred to the roller is typically less than the amount of release agent present in the release agent patches on the roller, the release agent can still transfer to a second side of a media sheet prior to printing the second side. The alternating sequence of the media sheets ensures that the section of the pressure roller that accumulates release agent from the first sides of duplexed media sheets only contacts the previously printed sides of duplexed media sheets, while a separate section of the pressure roller only contacts blank sides of media sheets that are free of release agent during first-side printing.

In the configuration of FIG. 2B, larger-sized media sheets 176 pass through the nip 134, and the circumference of the pressure roller 136 is greater than the length of a single one of the media sheets 176 in the process direction. The pressure roller 136 engages one of the media sheets 176 in each rotation in a single-pitch configuration, and release agent patch 180 is transferred to a single portion of the surface of the pressure roller 136. The printer 100 controls the rotation of the rollers 132 and 136 and the speed of the media sheets 176 in the media path 112 to enable the media sheet 176 to enter the nip 134 as the release agent patch 180 exits the nip 134. In the single-pitch configuration, each media sheet in the print job enters the nip 134 as the release agent patch 180 exits the nip 134, and the second side of each media sheet is free of release agent for duplex printing.

During a print job, the pressure roller 136 contacts the spreader roller 132 and remains in contact with roller 132 as multiple media sheets pass through the nip 134. An actuator 138 removes the pressure roller 136 from contact with the roller 132 between print jobs and during maintenance operations in the printer 100. A cleaning process removes release agent and other contaminants from the pressure roller 136 when the pressure roller 136 is removed from contact with the spreader roller 132. The actuator 138 moves the pressure roller 136 into engagement with roller 132 at the beginning of a print job. This engagement can be done quickly so that the transfer of release agent to the pressure roller 136 is minimized.

In the printer 100, the controller and user interface 190 is operatively connected to various components and subsystems, including the media path 112, the print zone 120, the actuators 133 and 138, and the sensor 164 that senses the rotation of the pressure roller 136. The controller 190 receives and processes print job data that include image data and print job parameters. Exemplary print job parameters include the number of copies of the image data to be generated, the image and color quality levels of the printed images, and whether the printer should print the media pages in a simplex or duplex print mode. In some configurations the controller 190 receives the print job data through a network interface module 196, while in alternative configurations, such as a photocopier, an optical scanner generates image data corresponding to one or more pages. One or more print job parameters may be entered via user input controls 192, and a visual display 194 displays information about the status of a print job, ink and print media supply levels, and errors or other diagnostic information that pertain to the status of the printer 100.

The controller 190 may be implemented with general or specialized programmable processors that execute programmed instructions, for example, printhead operation. The instructions and data required to perform the programmed functions may be stored in memory associated with the processors or controllers. The processors, their memories, and interface circuitry configure the controllers to perform the processes, described more fully below, that enable the printer 100 to control the transfer of release agent during duplex printing. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

During operation, the controller 190 generates electronic firing signals to operate individual inkjets in the printheads in each marking stations 122A-128B as the media sheet moves through the print zone 120. The inkjets in the marking stations 122A-128B eject individual ink drops in response to each firing signal to form an ink image on each media sheet. To generate color images, the printer 100 ejects ink drops of different colors in close proximity to one another on the media sheet to form "dithered" patterns that the human eye perceives as a wide gamut of colors.

Figure 3:
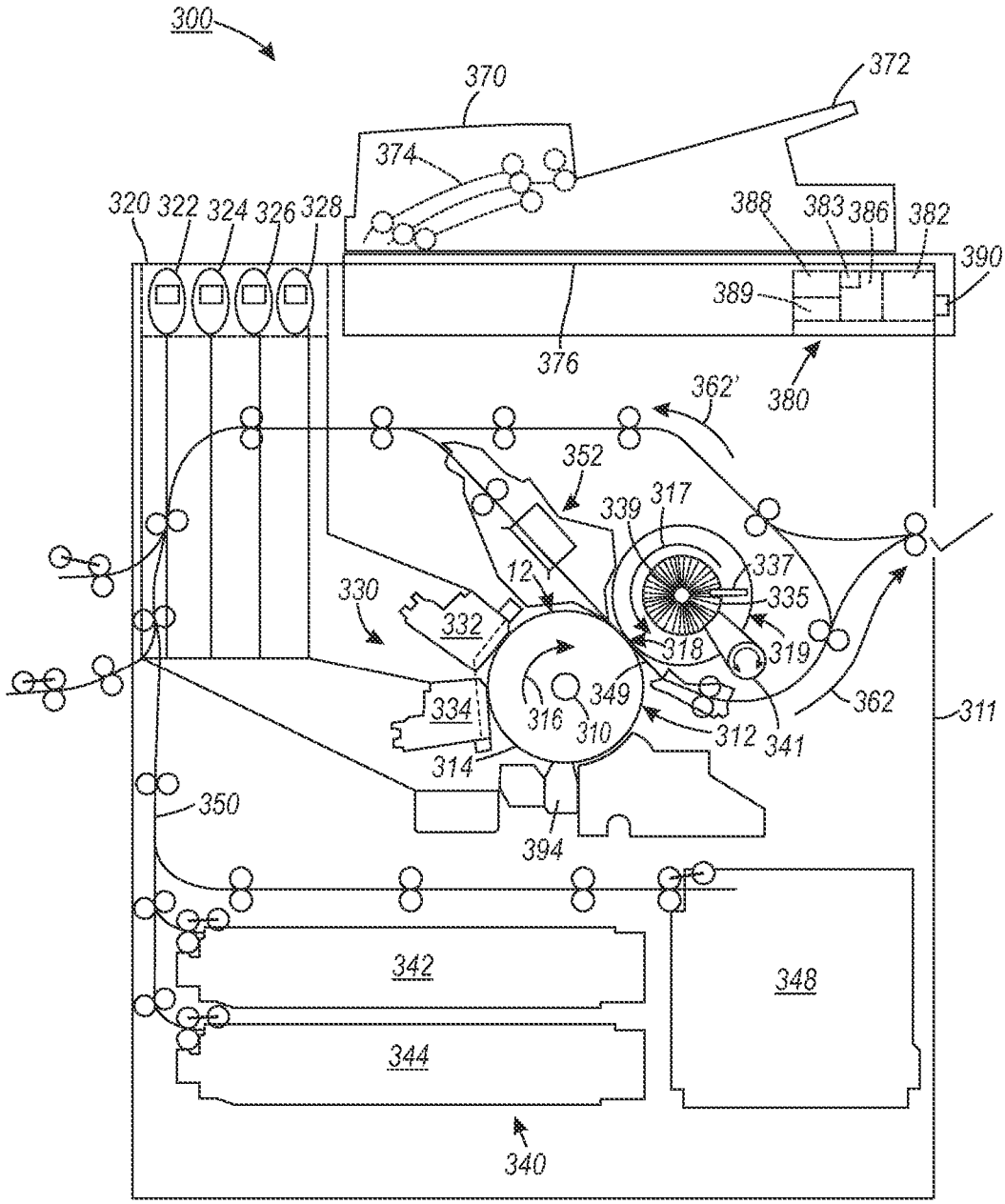
FIG. 3 is a schematic view of an inkjet printer that is configured to print images onto a rotating image receiving member and transfer the images to media sheets.

FIG. 3 depicts an embodiment of an indirect phase change inkjet printer 300 including a multi-color printhead assembly 332 and multi-color printhead assembly 334, rotating imaging drum 312, transfix roller 319, optical encoder disk 335 and controller 380. As illustrated, the printer 300 includes a frame 311 to which the operating subsystems and components described below are mounted directly or indirectly. The indirect phase change inkjet printer 300 includes an intermediate image receiving member 312 that is shown in the form of an imaging drum, but in other embodiments is in the form of a supported endless belt. The imaging drum 312 has an image receiving surface 314 that is movable in the direction 316, and on which phase change ink images are formed. A drum maintenance unit 394 includes a supply of release agent and applicators including rollers and metering blades that distribute a thin layer of release agent on the surface of the imaging drum 312. A transfix actuator 341 moves the transfix roller 319 into and out of engagement with the imaging drum 312. The transfix roller 319 rotates in the direction 317 when placed against the surface 314 of drum 312 to form a transfix nip 318 within which ink images formed on the surface 314 are transfixed onto a heated media sheet 349 that passes through the transfix nip 318.

During operation, the rotational position of the transfix roller 319 is monitored by a rotational sensor including an optical encoder disk 335 and a sensor 337. The optical encoder disk is mounted on an axle of the transfix roller 319 and rotates with the transfix roller 319. The optical encoder disk 335 and optical sensor 337 operate in the same manner as the optical encoder disk 160 and sensor 164 depicted in FIG. 2. In still another embodiment, the transfix roller 319 is configured with a Hall Effect sensor. The controller 380 identifies the rotational position and rotational velocity of the transfix roller 319 with reference to the signals generated by the optical sensor 337.

A media transport, depicted as media path 350, includes a plurality of rollers and media guides that control the movement of media sheets such as media sheet 349 through the transfix nip 318 in a process direction 362. The media path 350 includes a duplex process direction 362'. In a duplex print mode, the printer 300 transfixes an ink image to a first side of a media sheet, and the media sheet moves through the media path 350 in the duplex process direction 362'. The media sheet passes through the transfix nip 318 a second time and the printer 300 transfixes a second ink image to the second side of the media sheet.

Operation and control of the various subsystems, components and functions of the printer 300, including the media path 350 and printhead assemblies 332 and 334, are performed with the aid of a controller or electronic subsystem (ESS) 380. The ESS or controller 380, for example, is a self-contained, dedicated computer having a central processor unit (CPU) 382 with a memory 383, and a display or user interface (UI) 386. The ESS or controller 380, for example, includes a sensor input and control circuit 388 as well as an ink drop placement and control circuit 389. In addition, the CPU 382 reads, captures, prepares and manages the image data flow associated with print jobs received from image input sources, such as the scanning system 376, or an online or a work station connection 390, and controls the printhead assemblies 332 and 334. As such, the ESS or controller 380 is the main multi-tasking processor for operating and controlling all of the other printer subsystems and functions.

The controller 380 may be implemented with general or specialized programmable processors that execute programmed instructions, for example, printhead operation. The instructions and data required to perform the programmed functions may be stored in the memory 383 associated with the processors or controllers. The memory 383 includes one or more digital data storage devices including, but not limited to, static and dynamic random access memory (RAM), magnetic and optical disk storage devices, read-only memory (ROM), and solid state data storage devices including NAND flash data storage devices. The processors, their memories, and interface circuitry configure the controllers to perform the processes, described more fully below, that enable operation of the imaging drum 312, transfix roller 319, optical sensor 337, and media path 350 to enable duplex printing while controlling a transfer of release agent to media sheets. These components may be provided on a printed circuit card or provided as a circuit in an application specific integrated circuit (ASIC). The CPU 382 may be implemented as a special-purpose VLSI circuit, or may be a general purpose microcontroller or processor including processors in the x86 and ARM families. Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The phase change ink printer 300 also includes a phase change ink delivery subsystem 320 that has multiple sources of different color phase change inks in solid form. Since the phase change ink printer 300 is a multicolor printer, the ink delivery subsystem 320 includes four (4) sources 322, 324, 326, 328, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 322, 324, 326, and 328 includes a reservoir used to supply the melted ink to the printhead system 330. In the example of FIG. 3, ink sources 322, 324, 326, and 328 supply cyan, magenta, yellow, and black inks, respectively, to the multi-color printhead assemblies 332 and 334. In some configurations, the imaging drum 312 completes two or more rotations as the printhead assemblies 332 and 334 form ink images on the imaging drum 312 in a multi-pass printing configuration. Alternative embodiments include systems with different media path configurations and systems that print full page images in a single rotational pass of the image receiving member.

The phase change ink printer 300 includes a substrate supply and handling subsystem 340. The substrate supply and handling subsystem 340, for example, may include sheet or substrate supply sources 342, 344, 348, of which supply source 348, for example, is a high capacity paper supply or feeder for storing and supplying image receiving substrates in the form of cut sheets 349, for example. In one configuration, the supply sources 342-348 store media sheets of different sizes such as letter, A4, legal, and tabloid media sizes. The printer 300 executes print jobs that specify the various media sheet sizes and the media supply path 350 extracts media sheets from one of the media sources 342-348 according to the media size specified in each print job. The substrate supply and handling subsystem 340 also includes the substrate media path 350 that has a substrate heater or pre-heater assembly 352. The phase change ink printer 300 as shown may also include an original document feeder 370 that has a document holding tray 372, document sheet feeding and retrieval devices 374, and a document exposure and scanning subsystem 376.

In operation, the printer 300 receives a print job containing image data for one or more images from either the scanning subsystem 376 or via the online or work station connection 390. Additionally, the controller determines and/or accepts related subsystem and component controls, for example, from operator inputs via the user interface 386, and accordingly executes such controls. During a warm up operation at the beginning of the print job, the controller 380 may activate one or more heaters in the ink delivery subsystem 320 and the printhead assemblies 332 and 334 to provide molten ink to each of the printheads and inkjets in the printer 300. The printer 300 performs a warm up operation subsequent to leaving a deactivated state or a low power sleep mode prior to commencement of the print job.

Printhead assemblies 332 and 334, when activated, eject ink drops onto selected locations of the imaging surface 314 to form ink images corresponding to the image data. Media sources 342, 344, and 348 provide image receiving substrates that pass through substrate media path 350 to arrive at transfix nip 318 formed between the image receiving member 312 and transfix roller 319 in timed registration with the ink image formed on the image receiving surface 314. As the ink image and media travel through the nip 318, the ink image is transferred from the surface 314 and fixedly fused to the image substrate within the transfix nip 318. During the imaging and transfixing operations, the controller 380 identifies the rotational position of the transfix roller 319 with reference to signals generated by the optical sensor 337 in response to rotation of the optical encoder disk 335. The controller 380 identifies one or more sections of the transfix roller 319 that carry release agent using the optical sensor 337 and the controller 380 regulates the media path 350 to supply media sheets to the transfix nip 318 as the release agent patches on the transfix roller 319 exit the transfix nip 318.

Figure 4B:
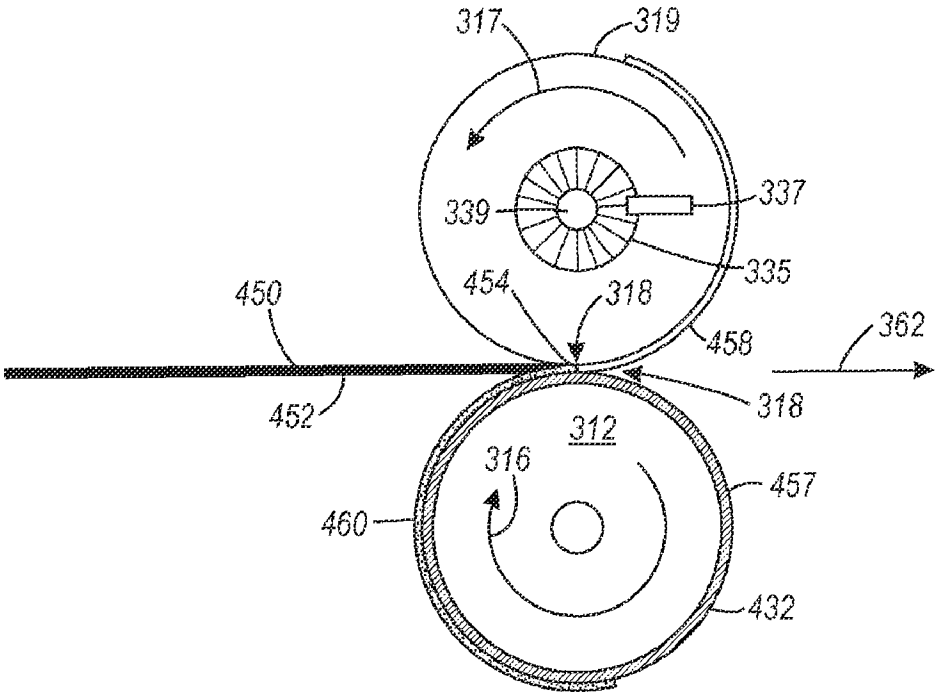
FIG. 4B is a schematic view of the imaging drum and transfix roller of FIG. 4A operating in a mode to fix ink images onto media sheets having a second size.

FIG. 4A and FIG. 4B depict the imaging drum 312 and transfix roller 319 of FIG. 3. FIG. 4A depicts a two-pitch printing mode where the printer 300 transfixes ink images to two media sheets during a single rotation of the transfix roller 319. In the example embodiment of FIG. 4A, the printer 300 forms two latent ink images 420 and 424 on a thin layer of release agent 432 that covers the surface of the imaging drum 312. The transfix roller 319 engages the imaging drum 312 to form a transfix nip 318 with the transfix roller engaging the imaging drum 312 in an inter-document gap 433 formed between the ink images 420 and 424. As used herein, the term "inter-document gap" refers to a portion of the surface of an image receiving member that is positioned between ink images corresponding to two different pages in a print job, or to a portion of the surface of the image receiving member that is positioned between two ends of a single ink image when a single ink image is formed on the image receiving member.

The imaging drum 312 rotates in direction 316 and the transfix roller 319 rotates in direction 317 as a first media sheet 440 approaches the transfix nip 318. A patch of release agent 434 transfers from the imaging drum 312 to the transfix roller 319 as the transfix roller 319 rotates through the inter-document gap 433. The leading edge 444 of a first media sheet 440 enters the transfix nip 318 as the portion of the transfix roller 319 carrying the release agent patch 434 exits the nip. The imaging drum 312 and transfix nip 319 rotate to transfix the ink image 420 to a first side 443 of the media sheet 440.

In a single-pass printing configuration, the transfix roller 319 remains in contact with the imaging drum 312 through a second inter-document gap 435 that contacts the transfix roller 319 at the location of a second release agent patch 436 formed on the transfix roller 319. A second media sheet 446 enters the transfix nip 318 as the second release agent patch 436 exits the transfix nip 318, and the imaging drum 312 and transfix roller 319 transfix the second ink image 424 to the first side 448 of the media sheet 446.

In a multi-pass configuration, the transfix roller 319 remains in contact with the imaging drum 312 through a portion of second inter-document gap 435 and the transfix actuator 341 subsequently disengages the transfix roller 319 from the imaging drum 312. The printhead assemblies 332 and 334 form ink images on one or more defined areas of the imaging receiving surface 314 as the imaging drum 312 completes two or more rotations. The transfix actuator 341 re-engages the transfix roller 319 with the imaging drum 312 in a position within one of the inter-document gaps on the imaging drum 312 after the images are formed on each area of the image receiving surface 314 of the imaging drum 312. Some multi-pass printer configurations include a transfix roller actuator that is configured to rotate the transfix roller 319 to engage a patch of release agent on the transfix roller 319 with the imaging drum 312 after ink images are formed on the imaging drum 312.

FIG. 4B depicts a single-pitch transfix operation in which a single latent ink image 460 is transfixed during a single rotation of the transfix roller 319. In FIG. 4B, the ink image 460 and a corresponding media sheet 450 are longer than one-half of the circumference of the transfix roller 319. To accommodate the longer media sheets 450, the printer 300 operates the media path 350 to sequence the sheets so that the transfix roller 319 rotates one time for each media sheet that passes through the transfix nip 318 in a single-pitch configuration. A single patch of release agent 458 transfers to one portion of the transfix roller 319 in the single-pitch mode. In the embodiment of FIG. 4A and FIG. 4B, the imaging drum 312 has approximately the same circumference as the transfix roller 319. Alternative embodiments, however, include imaging drums with a wide range of sizes, the imaging drum be the same size as the transfix roll or that it be sized such that an integer number of images can be formed around the circumference of the imaging drum. The transfix roller 319 engages the imaging drum in the inter-document gap 457. As the imaging drum 312 and transfix roller 319 rotate in contact with each other, a portion of the release agent 432 on the imaging drum 312 can transfer to the transfix roller 319 to form a release agent patch 458. The printer 300 controls the rotation of the imaging drum 312 and the movement of the media sheet 450 to pass a leading edge 454 of the media sheet 454 through the transfix nip 318 as the patch 458 exits the transfix nip 318. The ink image 460 formed on the imaging drum 312 transfixes to one side 452 of the media sheet 450 as the media sheet 450 moves through the transfix nip 318.

FIG. 4A is referred to as a two-pitch configuration where two areas with minimal release agent are formed on the transfix roller 319, and FIG. 4B is a single-pitch configuration. Alternative transfix roller and media sheet sizes can operate with three or more pitches around the transfix roller as well. As described in more detail below, the controller 380 identifies the rotational position of the transfix roller 319 with the optical sensor 337 and identifies the portions of the transfix roller 319 that carry the release agent patches 434 and 436 in FIG. 4A, or the release agent patch 458 in FIG. 4B. The controller 380 adjusts the rotation of the imaging drum 312 and the timing of the media path 350 so that the leading edge of each media sheet passes through the nip 318 as a corresponding patch of release agent exits the nip 318. Consequently, the second side of each of the media sheets 440, 446, and 450 is substantially free of release agent prior to a duplex imaging operation. In the printer 300, the transfix actuator 341 removes the transfix roller 319 from engagement with the imaging drum 312. A transfix roller actuator 339 rotates the transfix roller 319 to a rotational position that enables a release agent patch formed on the transfix roller 319 to contact an inter-document gap on the imaging drum 312 at the beginning of another transfix operation.

Figure 5:
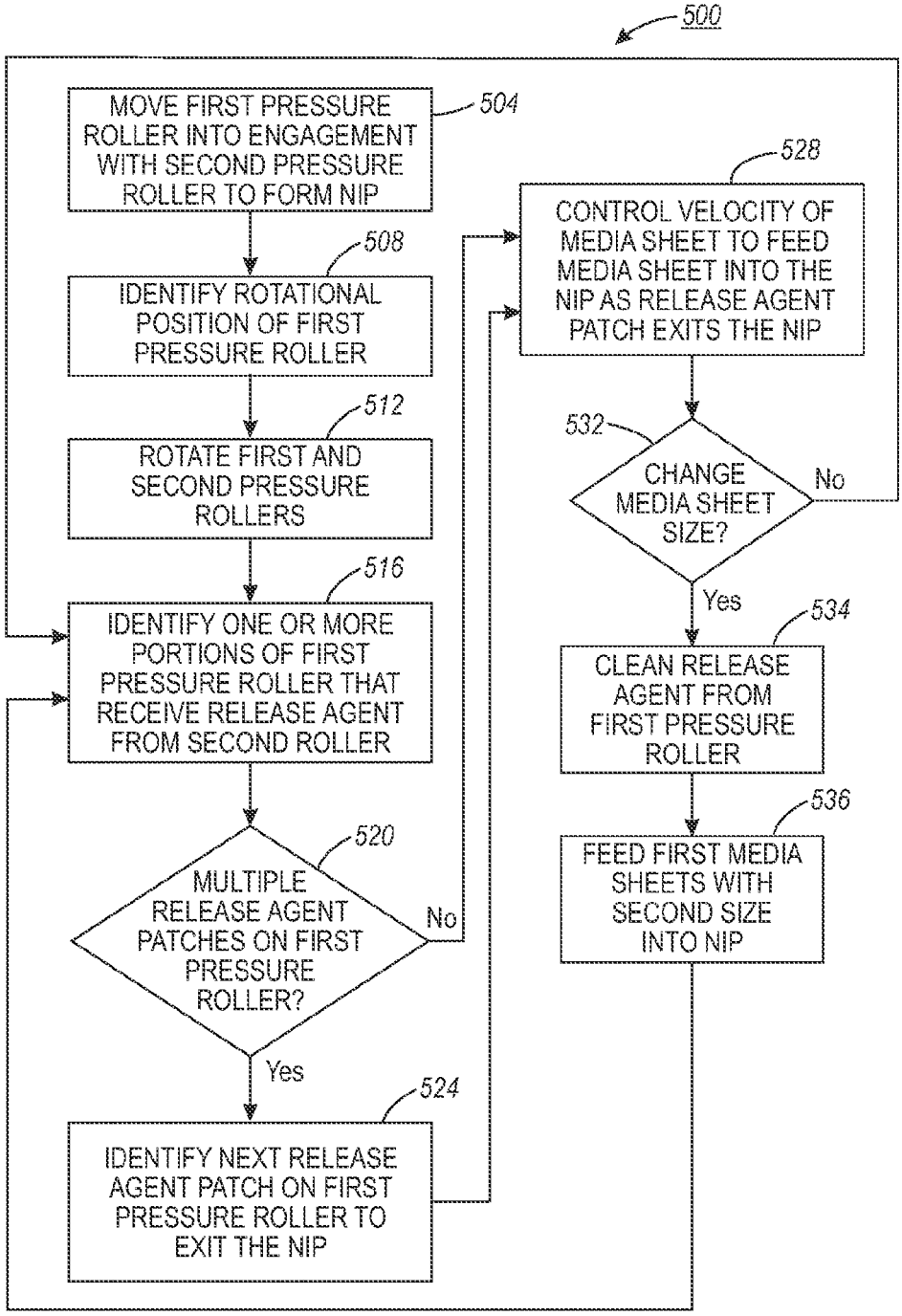
FIG. 5 is a block diagram of a process for operating an inkjet printer in a duplex printing mode to control the transfer of a release agent between the two rollers in the printer.

FIG. 5 depicts a process 500 for printing to media sheets in a duplex mode while preventing a transfer of release agent to an unprinted side of a media sheet. In this figure, the term pressure roller is used to describe the imaging drum, transfix roller, spreader roller or pressure roller described in FIGS. 2 and 3. Process 500 is described in conjunction with the printers 100 and 300 for illustrative purposes. Process 500 begins as a first pressure roller moves into contact with a second pressure roller to form a nip (block 504). In printer 100, the controller 190 operates actuator 138 to move pressure roller 136 into contact with spreader roller 132, and in printer 300, the controller 380 operates actuator 341 to move the transfix roller 319 into contact with the imaging drum 312.

Process 500 identifies the rotational position of the first pressure roller with reference to signals from the rotational sensor as the first pressure roller engages the second pressure roller (block 508). In printer 100, the controller 190 identifies the rotational position of the pressure roller 136 with reference to signals generated by the sensor 164 as the encoder disk 160 rotates with the pressure roller 136. Similarly, in the printer 300, the controller 380 identifies the rotational position of the transfix roller 319 with reference to signals generated by the sensor 337 as the encoder disk 335 rotates with the transfix roller 319. In the printer 300, the controller 380 optionally operates the actuator 339 to rotate the transfix roller 319 into a predetermined rotational position prior to engaging the transfix roller 319 to the imaging drum 312. The pre-positioned transfix roller engages the imaging drum 312 with a portion of the transfix roller 319 that carries a patch of release agent from an earlier transfix operation. The pre-positioning of the transfix roller 319 reduces a need to clean release agent from the transfix roller between imaging operations on the imaging drum 312.

Process 500 continues as the first and second pressure rollers rotate prior to the arrival of a media sheet in the nip (block 512). In printer 100, actuator 133 rotates spreader roller 132 and the rotation of the spreader roller 132 also rotates pressure roller 136. As the two rollers rotate in contact with each other, some of the release agent on spreader roller 132 transfers to pressure roller 136. In printer 300, an actuator 310 rotates the imaging drum 312 and the transfix roller 319 rotates with the imaging drum 312. In various configurations, either roller or both rollers may be connected to one or more actuators to rotate prior to a media sheet reaching the nip.

Process 500 identifies at least one portion of the first pressure roller that directly contacts the release agent formed on the second pressure roller when no media sheet is present in the nip (block 516). In the printer 100, the controller 190 identifies the rotational velocity of pressure roller 136 with reference to the signals from the sensor 164. The controller 190 identifies one or more portions of the pressure roller that receive a release agent patch while the two pressure rollers rotate in direct contact with each other based on the rotational position and velocity of the pressure roller 136 and the time at which the media sheet enters the nip 134. In the printer 300, the controller 380 identifies the rotational velocity of the transfix roller 319 with reference to the signals from the sensor 337. The controller 380 identifies one or more portions of the pressure roller that receive a release agent patch while the two rollers rotate in direct contact with each other based on the rotational position and velocity of the transfix roller 319 and the time at which the media sheet enters the transfix nip 318.

In some print modes, multiple portions of the pressure roller 136 carry release agent. FIG. 2A depicts pressure roller 136 as the pressure roller 136 carries release agent patches 168 and 172 in configurations where two or more media sheets, such as media sheet 156, pass through the nip 134 during a single rotation of the pressure roller 136. The number and size of release agent patches on the pressure roller 136 depend on the dimensions of pressure roller 136 and media sheets that pass through the nip 134. In other configurations the pressure roller 136 carries a single release agent patch. In FIG. 2B, the pressure roller 136 engages longer media sheets 176 and carries the single patch of release agent 180. FIG. 4A depicts a similar configuration in printer 300 where the transfix roller 319 carries two release agent patches 434 and 436.

If the pressure roller carries two or more patches of release agent (block 520) then the printer identifies one of the release agent patches formed on the first pressure roller that is present in the nip as the next media sheet approaches the nip with reference to the rotational position of the first pressure roller (block 524). In the printer 100, the controller 190 identifies the rotational position of the pressure roller 136 and the next release agent patch with the rotational sensor 164. In the printer 300, the controller 380 identifies the rotational position of the transfix roller 319 and the next release agent patch with the rotational sensor 337.

Process 500 controls the media path to adjust the velocity of the next media sheet in the media path so that the leading edge of the next media sheet arrives at the nip as the next release agent patch exits the nip (block 528). In a single-pitch configuration, the printer adjusts the velocity of the media sheet so that the leading edge arrives when the first roller is in a rotational position corresponding one end of the single release agent patch. In the printer 100, the controller 190 identifies the rotational position of the pressure roller 136 as the patch 180 exits the nip 134 with the sensor 164, and operates the conveyors 114 to move the media sheet into the nip 134. In printer 300, the controller 380 identifies the rotational position of the transfix roller 319 as the patch 458 exits the nip 318, and operates the media path 350 to move a media sheet into the nip 318. In the multi-pitch configuration, the printer identifies a rotational position of the first pressure roller as the next release agent patch identified in block 524 exits the nip, and the printer adjusts the media transport velocity to enable the next media sheet to be inserted into the nip as the next release agent patch exits the nip.

In either the single patch or multiple patch configuration, a portion of the release agent on the pressure roller 136 or transfix roller 319 may contact the second side of a media sheet near the leading edge of the media sheet. Release agent may contact the second side of the media sheet due to slippage between the two rollers forming the nip and due to small errors in the positioning of the media sheet. If release agent transfers to a portion of the second side of the media sheet corresponding to a margin where no ink image will be formed, then the printer prints the second side of the media sheet without image dropout. Consequently, the printers 100 and 300 can print in a duplex mode without dropout in cases where the release agent transfers to a portion of the media that is outside of the area of the media sheet that receives an ink image.

In some print jobs, process 500 continues through blocks 516 to 528 to print images to a plurality of media sheets having a single size, including printing in a duplex mode to both sides of each of the plurality of media sheets. Process 500 continues until the printer begins printing to media sheets having a different size (block 532). When the size of the media sheet changes, the printer cleans release agent from the first pressure roller (block 534). Printer 100 cleans release agent from the pressure roller 136, and printer 300 cleans release agent from the transfix roller 319. Some printer embodiments include a cleaning device, such as a cleaning roller or web, which removes the release agent. Other printer embodiments pass one or more sacrificial media sheets through the nip to clean the release agent from the first pressure roller before printing images on the differently sized media sheets.

After cleaning the first pressure roller, the first media sheet having the second size passes through the nip (block 536). In one example, the second media sheet size is small enough to operate in a multi-pitch configuration with the first pressure roller. For example, the media sheet 440 enters the nip 318 following transfix operations with the longer media sheets 450. After two or more of the media sheets 440 pass through the nip 318, the contact between the transfix roller 319 and imaging drum 312 transfers two new patches of release agent on the transfix roller 319 corresponding to the inter-document gaps between the shorter media sheets. In a similar manner, if the longer media sheet 450 enters the nip in a single-pitch configuration, a new release agent patch is formed on the transfix roller 319 that corresponds to the length of the inter-document gaps between the longer media sheets. As the media sheets with the second size pass through the nip, process 500 identifies one or more portions of the first pressure roller that contact the second pressure roller (block 516) and process 500 continues with the media sheets having the second size.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method of operating a printer comprising:

ejecting ink drops into an area having a predetermined size on a moving surface to form a first ink image;

identifying a first portion of a surface of a first roller having release agent, the first portion of the surface of the first roller having release agent being less than a circumference of the first roller and the circumference of the first roller being greater than a length of the area having the predetermined size in which the first ink image was formed;

identifying a rotational position of the first portion of the surface of the first roller having release agent; and operating a media transport to insert a leading edge of a media sheet into a nip formed with the first roller as the identified rotational position of the first portion of the surface of first roller having release agent exits the nip.

2. The method of claim 1 further comprising:

moving the first roller into engagement with a rotating image receiving member to form the nip, the rotating image receiving member carrying the area of the predetermined size in which the first ink image was formed; and operating the media transport to insert the leading edge of the media sheet into the nip as the area having the predetermined size on the rotating image receiving member enters the nip.

3. The method of claim 1 further comprising:

applying release agent on a second roller as the second roller rotates; and moving the first roller into engagement with a rotating second roller to form the nip, the media sheet carrying the first ink image formed in the area having the predetermined size.

4. The method of claim 3 further comprising:

selectively moving the first roller into and out of engagement with the second roller to form the nip.

5. The method of claim 3 further comprising:

ejecting ink drops onto a second side of the media sheet to form a second ink image after the first ink image has passed through the nip; and operating the media transport to insert the leading edge of the media sheet into the nip formed with the first roller to enable the second side of the media sheet to contact the second roller, the leading edge of the media sheet being inserted as the identified rotational position of the first portion of the surface of first roller having release agent exits the nip.

6. The method of claim 1, the identifying of the first portion of the first roller having release agent further comprising:

identifying an angular rotational speed of the first roller; and identifying the position of the first portion of the surface of the second roller having the release agent with reference to the identified angular rotational speed of the first roller.

7. The method of claim 6, the identification of at least one of the rotational speed and position being made with an optical encoder configured to rotate as the first roller rotates.

8. The method of claim 3 further comprising:

adjusting the area on the rotating image receiving member to a second predetermined size;

ejecting ink drops into the area having the second predetermined size to form a second ink image;

identifying a second portion of the surface of the first roller having release agent with reference to the second predetermined size, the second portion of the first roller having release agent being less than a circumference of the first roller and the circumference of the first roller being greater than a length of the area having the second predetermined size in which the second ink image was formed;

identifying a rotational position of the second portion of the surface of the first roller having release agent; and operating the media transport to insert a leading edge of the media sheet into a nip formed with the first roller as the identified rotational position of the second portion of the surface of first roller exits the nip.

9. The method of claim 1, further comprising:

operating the media transport to insert a leading edge of a letter size media sheet into the nip as the first portion of the surface of the first roller exits the nip, the circumference of the first roller being larger than two times a length of the letter size media sheet in a process direction, and a second portion of the surface of the first roller having the release agent entering the nip after the letter size media sheet exits the nip;

identifying a rotational position of the second portion of the surface of the first roller having release agent; and operating the media transport to insert a leading edge of a next letter size media sheet into the nip as the identified second portion of the surface of first roller exits the nip.

10. The method of claim 9 further comprising:

operating the media transport to move an alternating sequence of media sheets through the nip, the alternating sequence of media sheets including media sheets undergoing a first side imaging operation in a duplex print mode alternated with media sheets undergoing a second side imaging operation in the duplex print mode.

11. The method of claim 1 wherein the ink drops ejected into the area on the moving surface are phase change ink drops.

12. The method of claim 1 further comprising:

cleaning the release agent from the surface of the first roller after inserting at least one media sheet having a first size into the nip and prior to inserting a media sheet having a second size into the nip.

13. A printer comprising:

a printhead configured to eject ink drops into an area having a predetermined size on a moving surface to form a first ink image;

a sensor configured to generate a signal that identifies a rotational position of a portion of a surface of a first roller having release agent; and a controller configured to operate a media transport to insert a leading edge of a media sheet into a nip formed with the first roller as the identified rotational position of the portion of the surface of first roller having release agent exits the nip, a circumference of the first roller being greater than a length of the area having the predetermined size.

14. The printer of claim 13 further comprising:

a rotating image receiving member that carries the first ink image in the area having the predetermined size; and the controller being further configured to move the first roller into engagement with the rotating image receiving member to form the nip and to operate the media transport to insert the leading edge of the media sheet into the nip as the area having the predetermined size enters the nip.

15. The printer of claim 13 further comprising:

a media sheet that carries the first ink image in the area having the predetermined size;

a second rotating roller;

a release agent applicator configured to apply release agent to the second rotating roller; and the controller being further configured to move the first roller into engagement with second rotating roller to form the nip.

16. The printer of claim 15 the controller being further configured to selectively move the first roller into and out of engagement with the second roller to form the nip.

17. The printer of claim 13, the controller being further configured to identify an angular rotational speed of the first roller with reference to the position of the portion of the first roller having release agent as indicated by the signal received from the sensor.

18. The printer of claim 17 wherein the sensor includes an optical encoder configured to rotate as the first roller rotates.

19. The printer of claim 13, wherein the printhead is configured to eject phase change ink drops.

20. The printer of claim 13, the circumference of the first roller being larger than two times a length of a letter size media sheet to enable two separate portions of the surface of the first roller to have the release agent when the printer prints at least one letter size media sheet, and the controller being further configured to operate the media transport to insert the leading edge of a letter size media sheet into the nip as one of the two portions of the surface of the first roller exits the nip.

21. The printer of claim 20 the controller being further configured to:

operate the media transport to move an alternating sequence of media sheets through the nip, the alternating sequence of media sheets including media sheets undergoing a first side imaging operation in a duplex print mode alternated with media sheets undergoing a second side imaging operation in the duplex print mode.

22. The printer of claim 13, the surface of the first roller further comprising a non-fractional number of pitches around the circumference of the first roller, each pitch having a length that is greater than a length of a media sheet in the process direction, a first portion of each pitch being configured to engage only a media sheet in the nip, and a second portion of each pitch being configured to engage only a surface that carries the release agent in the nip, the first portion of each pitch on the first roller being configured to engage an entire length of one media sheet in the process direction during a single rotation of the first roller.

23. The printer of claim 22, the controller being further configured to:

operate the media transport to move media sheets having a process length that is more than one-half of the circumference of the first roller through the nip, a leading edge of each media sheet entering the nip as the second portion of a single pitch on the first roller exits the nip, the first roller being configured to engage a single media sheet in the nip during a single rotation.

24. The printer of claim 22, the controller being further configured to:

operate the media transport to move media sheets having a process direction length that is less than one-half of the circumference of the first roller through the nip, a leading edge of each media sheet entering the nip as the second portion of one of two pitches on the first roller exits the nip, the first roller being configured to engage two media sheets in the nip during a single rotation.

25. The printer of claim 22, the controller being further configured to:

operate the media transport to move media sheets having a process direction length that is less than one-third of the circumference of the first roller through the nip, a leading edge of each media sheet entering the nip as the second portion of one of three pitches on the first roller exits the nip, the first roller being configured to engage three media sheets in the nip during a single rotation.

* * * * *